US008833538B2

(12) United States Patent
Oh

(10) Patent No.: US 8,833,538 B2
(45) Date of Patent: Sep. 16, 2014

(54) AUTOMATIC TELLER MACHINE (ATM) FOR VEHICLE DRIVER

(75) Inventor: Kyoung Suck Oh, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 844 days.

(21) Appl. No.: 12/620,549

(22) Filed: Nov. 17, 2009

(65) Prior Publication Data

US 2010/0126805 A1 May 27, 2010

(30) Foreign Application Priority Data

Nov. 17, 2008 (KR) ..... 10-2008-0114150

(51) Int. Cl.
*G07F 9/10* (2006.01)
*G07F 19/00* (2006.01)

(52) U.S. Cl.
CPC ..... *G07F 19/205* (2013.01); *G07F 19/20* (2013.01); *Y10S 902/21* (2013.01); *Y10S 902/30* (2013.01); *Y10S 902/33* (2013.01); *Y10S 248/923* (2013.01)
USPC ..... 194/350; 902/21; 902/30; 902/33; 361/679.01; 361/679.06; 361/679.07; 248/923

(58) Field of Classification Search
USPC ..... 361/679.06, 679.07, 679.01; 248/917–923; 902/25–27, 33; 194/206, 194/207, 350; 209/534
See application file for complete search history.

(56) References Cited

U.S. PATENT DOCUMENTS

| | | | | |
|---|---|---|---|---|
| 4,735,289 | A * | 4/1988 | Kenyon | 186/37 |
| 5,644,119 | A * | 7/1997 | Padula et al. | 235/384 |
| 6,296,079 | B1 * | 10/2001 | McNaughton | 186/37 |
| 6,554,242 | B2 * | 4/2003 | Kim | 248/371 |
| 6,754,070 | B2 * | 6/2004 | Chen | 361/679.26 |
| 6,812,917 | B2 * | 11/2004 | Jenkins et al. | 345/156 |
| 7,644,039 | B1 * | 1/2010 | Magee et al. | 705/43 |
| 2007/0236114 | A1 * | 10/2007 | Fuentes | 312/246 |
| 2008/0149795 | A1 * | 6/2008 | Oh et al. | 248/276.1 |
| 2009/0057514 | A1 * | 3/2009 | Oh | 248/282.1 |

FOREIGN PATENT DOCUMENTS

| | | |
|---|---|---|
| JP | 7-210613 | 8/1995 |
| JP | 7-272064 | 10/1995 |

* cited by examiner

*Primary Examiner* — Jeffrey Shapiro
(74) *Attorney, Agent, or Firm* — Fenwick & West LLP

(57) ABSTRACT

The present invention relates to an automated teller machine for a vehicle driver, and more particularly, to an automated teller machine for a vehicle driver in which a display unit itself of the automated teller machine is configured to be rotatable so that the vehicle driver may manipulate the display unit conveniently, whereby the vehicle driver can easily verify the data displayed on the display unit and input the information as necessary. The automated teller machine for a vehicle driver according to the present invention comprises a main body installed in a financial service area; a panel unit provided on a front surface of the main body to be provided with a financial transaction means; a display unit provided at one side of the panel unit, the display unit being configured to be rotatable frontward and rearward; a manual button unit provided at a predetermined location of the panel unit to receive a rotational angle of the display unit from a vehicle driver; and a control unit for controlling the rotational angle of the display unit through a signal transmitted from the manual button unit.

4 Claims, 8 Drawing Sheets

AUTOMATIC TELLER MACHINE (ATM) FOR VEHICLE DRIVER

BACKGROUND OF THE INVENTION

1. Field of the Invention

The present invention relates to an automated teller machine for a vehicle driver, and more particularly, to an automated teller machine for a vehicle driver in which a display unit itself of the automated teller machine is configured to be rotatable so that the vehicle driver may manipulate the display unit conveniently, whereby the vehicle driver can easily verify the data displayed on the display unit and input the information as necessary while the vehicle driver remains in a vehicle.

2. Description of the Related Art

An automated teller machine (ATM) is an automated machine which can assist basic financial services such as deposit or withdrawal without any bank clerk regardless of time and place in relation to financial services. The automated teller machine is constructed such that a customer can directly perform financial transactions such as deposit and withdrawal with a medium such as an ATM card or a bankbook.

Recently, in the financial institutions, the automated teller machines have been increasingly installed in order to substitute the bank teller's inherent service with the automated teller machines due to the reduction in labor costs.

In the meantime, such automated teller machines have been installed at various places such as unmanned sectors for the financial institutions, convenience stores, public institutions and the like. Recently, for the convenience of customers driving their respective vehicles, a financial service area for a vehicle driver has been generated in the financial institutions in order that even a customer within a vehicle can utilize the automated teller machines.

However, since the automated teller machine in such a financial service area is installed such that the customer can perform the financial transactions through a window of the vehicle while the customer is in the vehicle, sometimes the customers have difficulty in verifying the information provided onto a display unit of the automated teller machine and inputting the data as necessary due to the difference in the heights of vehicles or customers.

In order to solve the above-mentioned problems, accordingly, an automated teller machine which is movable has been developed, and such an automated teller machine is disclosed in U.S. Pat. No. 4,735,289 entitled "Dispensing Apparatus and Deposit Apparatus for Drive up Machine" (herein, referred to as "Prior Art 1") and Japanese laid open patent publication No. 1995-272064 entitled "Automated Transaction Apparatus (herein, referred to as "Prior Art 2").

FIG. 1 is a view illustrating a configuration of Prior Art 1 described above.

Referring to FIG. 1, an automated teller machine according to Prior Art 1 consists of a data input unit 1 manipulated by a driver, a sensing means 2 for sensing a window of a vehicle, and a moving means 3 for enabling the data input unit 1 to be moved vertically and horizontally by means of the sensing means 2. If the vehicle is introduced into and stopped in a financial service area, the sensing means 2 senses the window of the vehicle so that the moving means 3 allows the data input unit 1 to be moved to a location adjacent to the window of the stopped vehicle, and therefore, the driver inputs the data through the data input unit 1.

FIG. 2 is a view illustrating a configuration of Prior Art 2 described above. An automated teller machine according to Prior Art 2 consists of a main body 1' for processing a financial transaction with a driver positioned within a vehicle, a location-detecting means 2' for detecting the location of the vehicle which is approaching toward the main body 1', and a main body location-adjusting means 3' for allowing the main body 1' to be moved horizontally and vertically according to the detection result of the location-detecting means 2' so that the location of the main body 1', the distance between the main body 1' and the vehicle, and the height of the main body 1' may be adjusted. When the vehicle approaches to the main body and is stopped, the location-detecting means 3' detects the vehicle, and the main body location-adjusting means 3' provided at a lower end of the main body 1' allows the main body 1' to be moved to a location adjacent to the vehicle. Then, the driver inputs the data.

In Prior Arts 1 and 2 as described above, the main body of the automated teller machine is configured to be directly moved to a location adjacent to the vehicle. In these structures, since the main body of the automated teller machine, which has a large volume, is directly moved to the driver, a large space is required for operating the automated teller machine. As such, the power consumption is so high that the efficiency of the automated teller machine is lowered. In addition, the driver waits until the main body is moved and approaches to the vehicle, and then performs the financial transaction, so that there is a problem in that the financial transaction is temporally delayed more or less.

Also, since the main body is directly moved in the forward and backward directions in a vehicle passage, the main body may cause an accident with the vehicle and influence detrimentally a safety of the vehicle driver.

SUMMARY OF THE INVENTION

The present invention is conceived to solve the above-mentioned problem. An object of the present invention is to provide an automated teller machine for a vehicle driver in which an angle of a display unit provided on a front surface of the automated teller machine is configured to be directly adjustable by a driver within a vehicle so that the driver may conveniently perform a financial transaction while the driver remains in the vehicle.

In order to achieve the above object, the automated teller machine for a vehicle driver according to the present invention comprises a main body installed in a financial service area; a panel unit provided on a front surface of the main body to be provided with a financial transaction means; a display unit provided at one side of the panel unit, the display unit being configured to be rotatable frontward and rearward; a manual button unit provided at a predetermined location of the panel unit to receive a rotational angle of the display unit from the vehicle driver; and a control unit for controlling the rotational angle of the display unit through a signal transmitted from the manual button unit.

As described above, the automated teller machine for a vehicle driver according to the present invention is constructed such that the driver within the vehicle introduced in the financial transaction area can directly adjust the angle of the display unit provided on the front surface of the automated teller machine, whereby the driver within a vehicle can conveniently verify the information, input information, and perform the financial transaction. Simultaneously, the present invention has the advantageous effects in that it is possible to install the automated teller machine in a narrow space and to save the maintenance cost due to the low power consumption.

DESCRIPTION OF THE PREFERRED EMBODIMENT

Hereinafter, preferred embodiments of the present invention will be explained in detail, but the present invention is not limited to the embodiments unless modifications and changes thereto are departed from the technical sprit of the invention.

Figure 1:
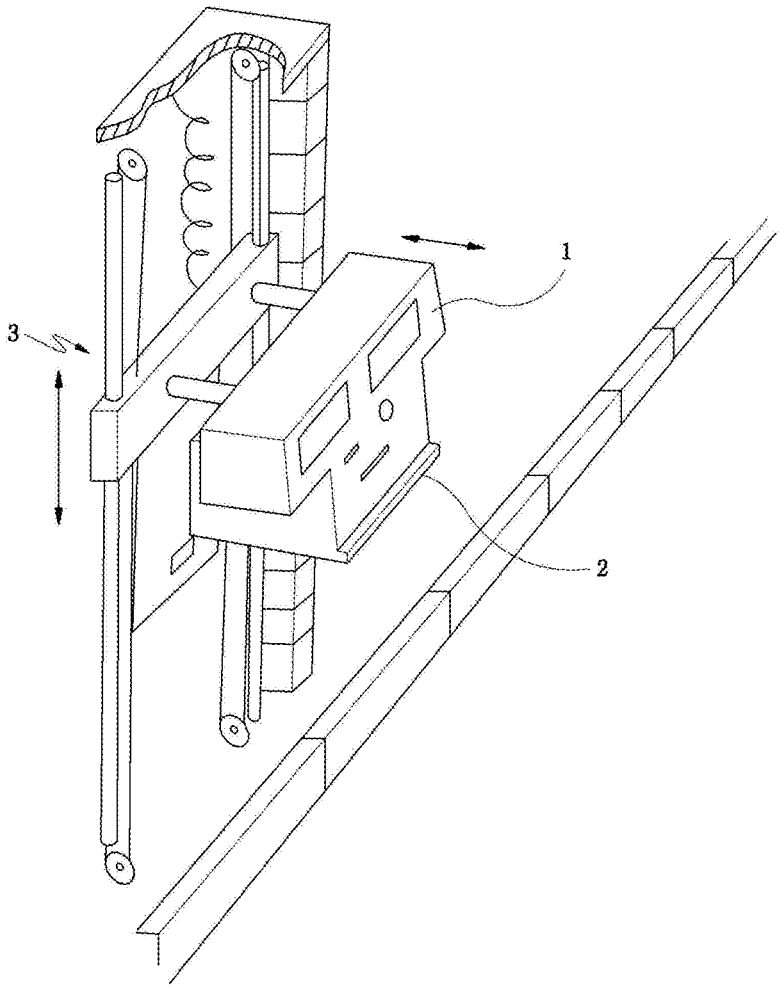
FIGURE 1 PRIOR ART
FIG. 1 is a view showing a configuration of an automated teller machine according to Prior Art 1.
Figure 2:
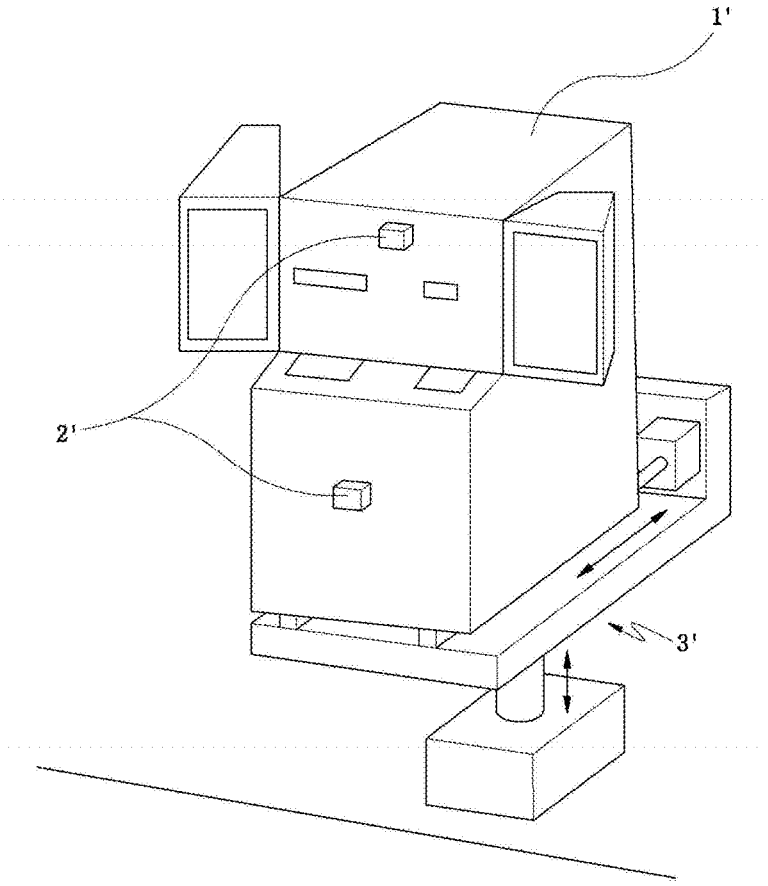
FIGURE 2 PRIOR ART
FIG. 2 is a view showing a configuration of an automated teller machine according to Prior Art 1.
Figure 3:
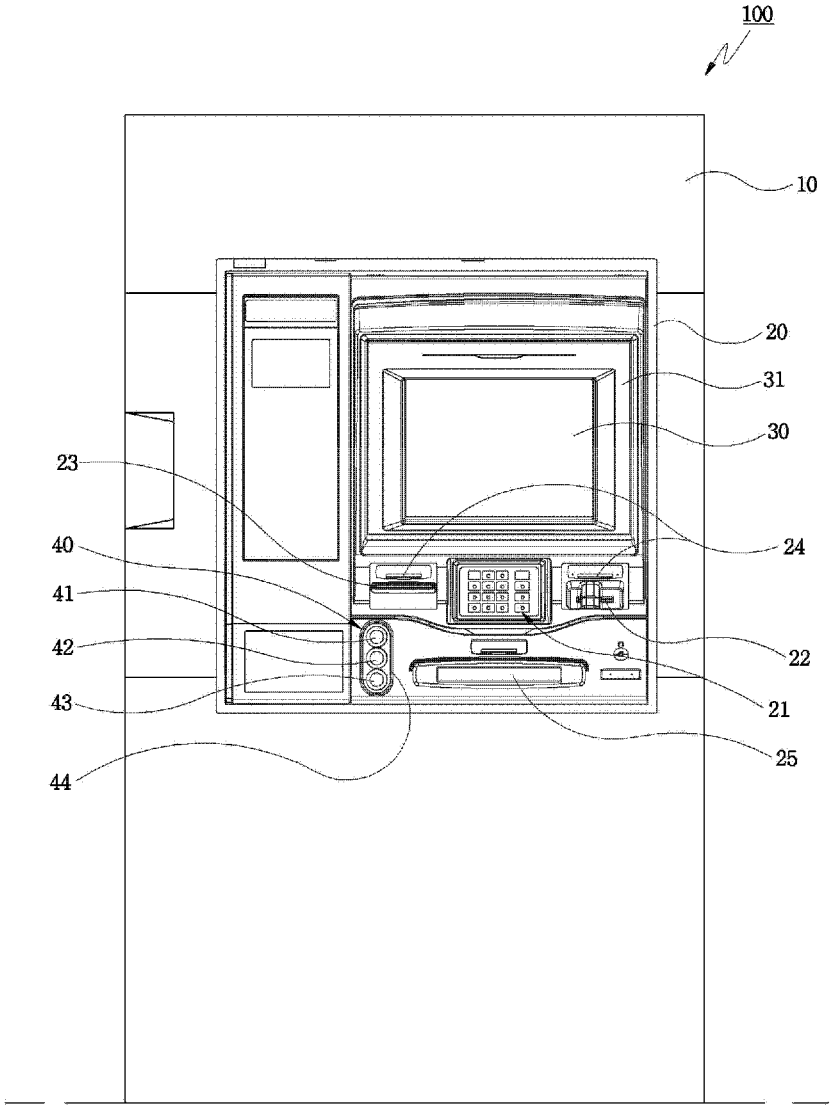
FIG. 3 is a view showing an external configuration of an automated teller machine for a vehicle driver according to the first embodiment of the present invention.
Figure 4:
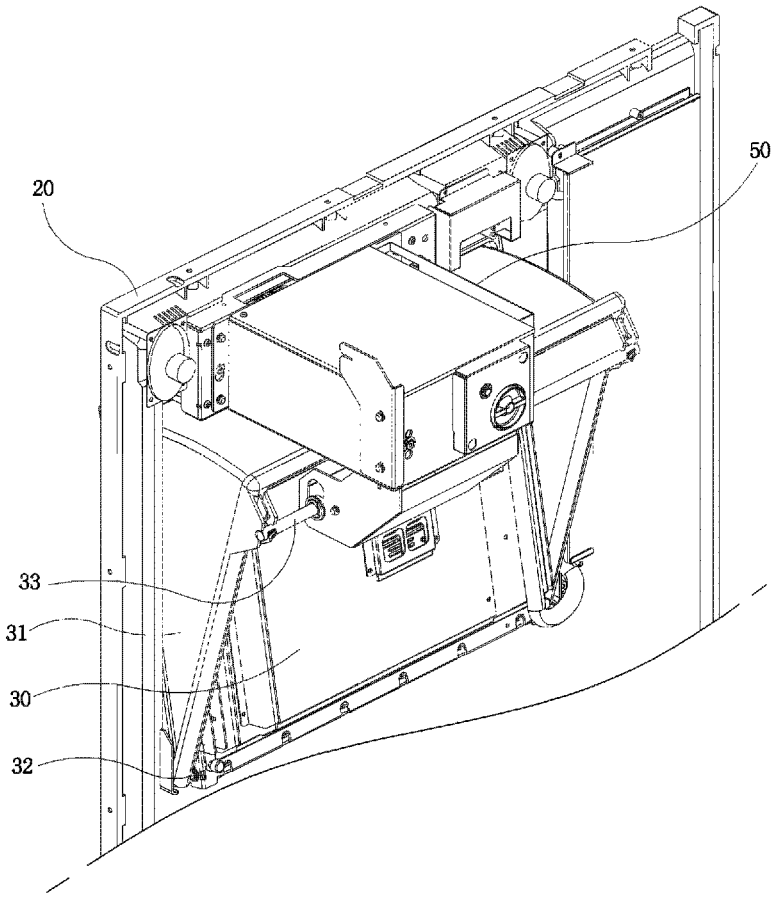
FIG. 4 is a view showing an internal configuration of an automated teller machine for a vehicle driver according to the first embodiment of the present invention.

FIG. 3 is a view showing an external configuration of an automated teller machine for a vehicle driver according to the first embodiment of the present invention, and FIG. 4 is a view showing an internal configuration of an automated teller machine for a vehicle driver according to the first embodiment of the present invention.

Referring to FIG. 3 and FIG. 4, the automated teller machine according to the first embodiment of the present invention comprises a main body 10 installed in a financial service area, a panel unit 20 provided on a front surface of the main body 10 to be provided with a financial transaction means, a display unit 30 provided at one side of the panel unit 20 to be rotatable frontward and rearward, a manual button unit 40 provided at a predetermined location of the panel unit 20 to receive a rotational angle of the display unit 30 from the vehicle driver, and a control unit 50 provided in the main body to control the rotational angle of the display unit through a signal transmitted from the manual button unit 40.

The main body 10 forms an external appearance of the automated teller machine and installed in the financial service area at which the vehicle driver conducts a financial transaction.

The panel unit 20 is provided at an upper portion of the main body so that the panel unit 20 is provided in the front surface thereof with a financial transaction means such as the display unit 30, a button-operating part 21, a card-inserting part 22, a bankbook-introducing part 23, a specification-outputting part 24 and a bill-depositing/withdrawing part 25, so that the driver within the vehicle may directly conduct the financial transaction.

The display unit 30 is a display means through which various kinds of information required for the financial transaction is inputted and outputted. The display unit 30 is composed of a touch screen to enable the driver to input necessary data with verifying the provided information while he(she) is sitting in the vehicle.

The display unit 30 is integrated with a housing 31 surrounding the external periphery of the display unit 30 and inserted into and fixed to the panel unit 20. Hinges 32 are provided at both side edges of a lower portion of the housing 31 to be fixed to the panel unit 20. As such, the housing 31 surrounding the display unit 30 can be rotated together with the display unit 30 within a certain angle range with respect to the hinges served as a rotational axis.

The display unit 30 is fixed to the panel unit 21 in a state where the display unit 30 is inclined forward by approximately 10° so that the driver within the vehicle may comfortably view the display unit 30. By means of the manual button unit 40 described later, the display unit 30 can be adjusted into a state in which the driver utilizes conveniently the display unit 30.

The manual button unit 40 consists of a plurality of operating buttons 41, 42 and 43 arranged on the front surface of the panel unit 20. Each of the operating buttons 41, 42 and 43 is configured to enable the display unit 30 to be rotated by a predetermined angle, so that each operating button 41, 42 or 43 transmits a signal to the control unit 50 described later to adjust a rotational angle of the display unit 30. In addition, a button frame 44 to which the operating buttons 41, 42 and 43 are mounted can be protruded by a certain height from the panel unit 20 so as to enable the driver within a vehicle to operate conveniently the operating buttons 41, 42 and 43.

For example, the manual button unit 40 can be configured such that the display unit 30 inclined at 10° from a surface of the panel unit 20 is further inclined by 8° when the operating button 41 located at the uppermost portion, the display unit is further inclined by 8° from the former location when the operating button 42 located at the mid portion and the display unit can be inclined by at the maximum angle at which the display unit can be inclined, when the operating button 43 located at the lower portion. In this description, the manual button unit 40 consisting of three operating buttons is illustrated. However, the manual button unit can be constructed to enable the display unit 30 to be rotated upward and downward at regular angle through only two buttons.

The control unit 50 is connected to the manual button unit 40 so that the control unit 50 may control the rotational angle of the display unit 30 by means of the signal transmitted from the manual button unit 40. That is, if the vehicle driver manipulates the manual button unit 40 to allow the signal to be transmitted to the control unit 50, the control unit 50 controls the rotational angle of the display unit 30 so that the rotational angle may be adjusted to an angle which corresponds to the corresponding operating buttons 41, 42 and 43.

In the meantime, an angle adjusting device 60 is provided within the panel unit 20 to enable the display unit 30 to be rotated forward and rearward, and the angle adjusting device 60 is connected to the control unit 50 and the housing 31 surrounding the display unit 30.

Figure 5:
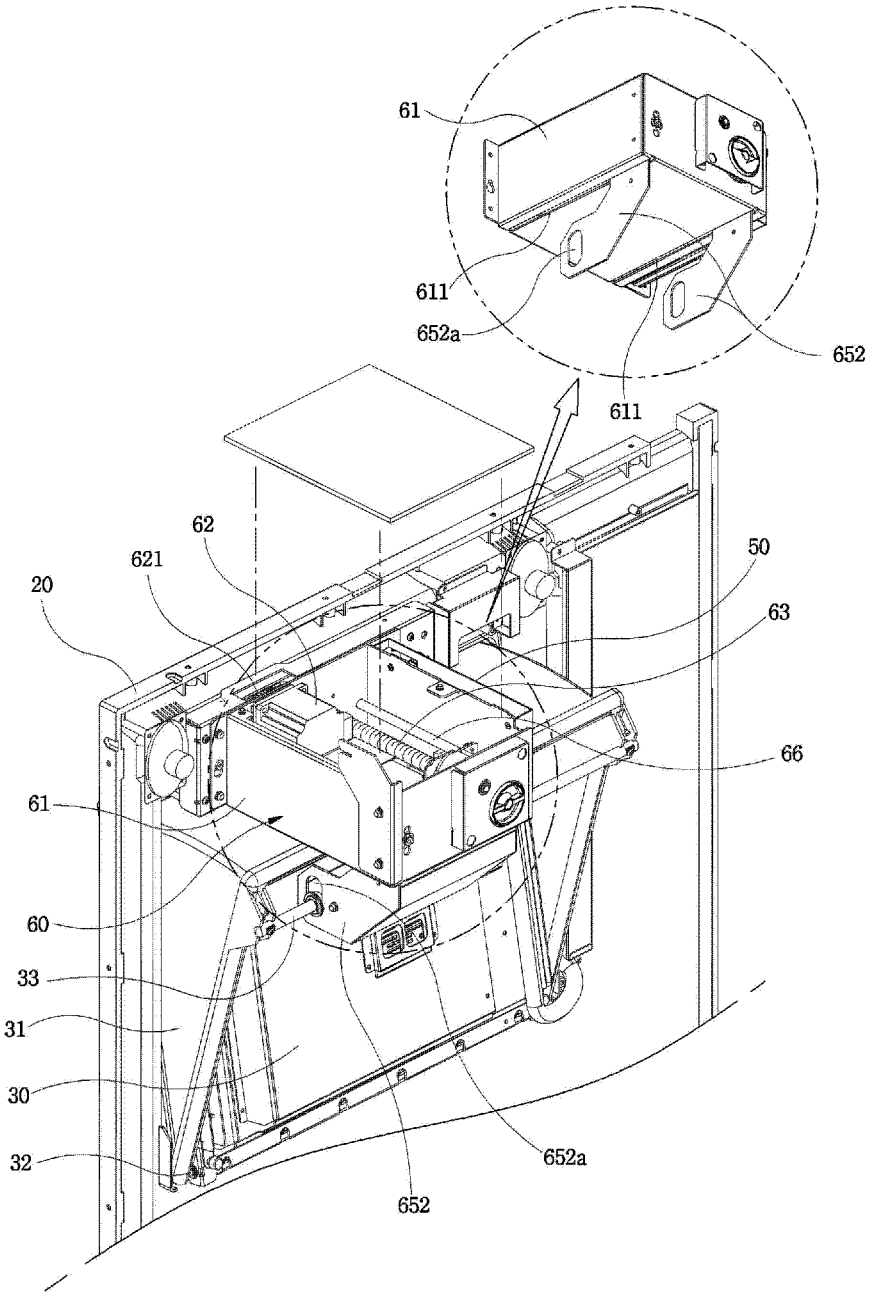
FIG. 5 is a view showing an external configuration of an angle adjusting device according to the first embodiment of the present invention.
Figure 6:
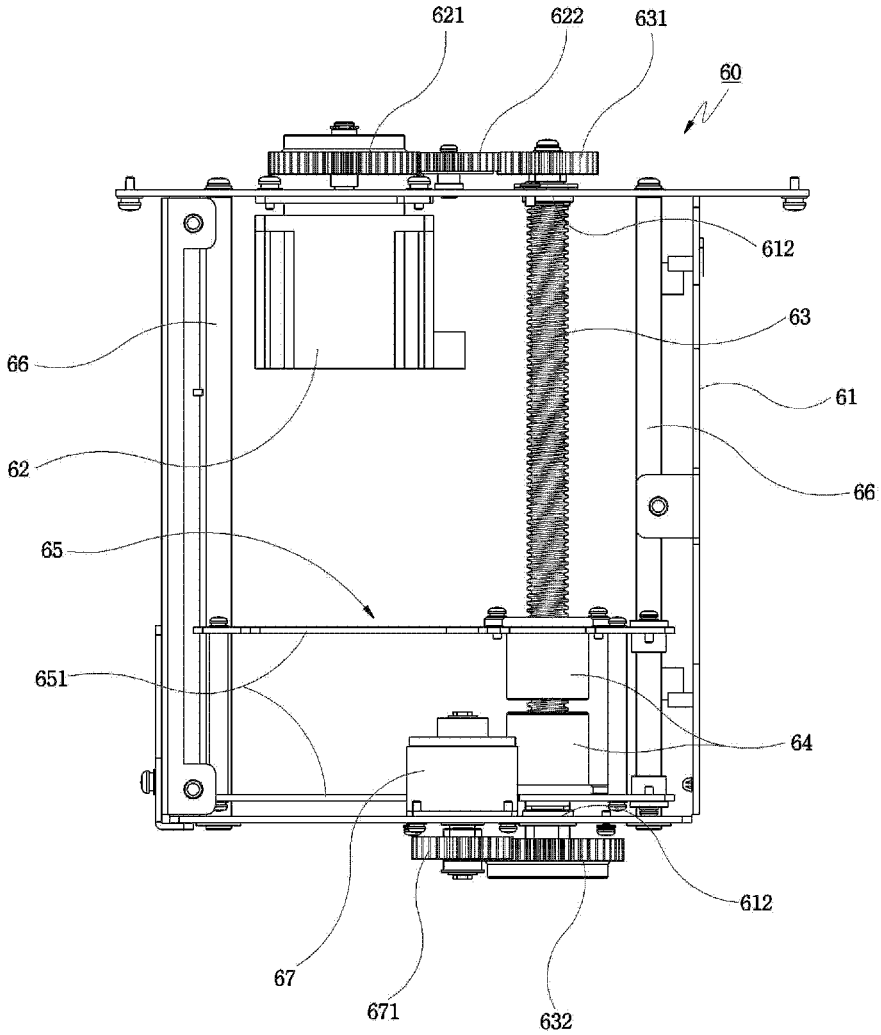
FIG. 6 is a view showing an internal configuration of an angle adjusting device according to the first embodiment of the present invention.

FIG. 5 is a view showing an external configuration of the angle adjusting device according to the first embodiment of the present invention, and FIG. 6 is a view showing an internal configuration of the angle adjusting device according to the first embodiment of the present invention.

Referring to FIG. 5 and FIG. 6, the angle adjusting device 60 includes a case 61; a driving motor 62 fixed to one inner side of the case 61; a transfer screw 63, one end of which is connected to the driving motor 62, to be rotated according to the operation of the driving motor 62; a transfer guide 64 inserted into and connected to the other end of the transfer screw 63 so that the rotation of the transfer screw 63 allows the transfer guide 64 to be transferred in the lengthwise direction of the transfer screw 63; and a transfer frame 65 coupled to the transfer guide 64 so that the transfer frame may be transferred in the lengthwise direction of the transfer screw 63 together with the transfer guide 64.

The driving motor 62, the transfer screw 63, the transfer guide 64 and the transfer frame 65 are accommodated in the case 61, and a pair of guide grooves 611 are formed on both sides of a lower surface of the case 61 in the lengthwise direction so that a fixing plate 652 for connecting the display unit 30 to the transfer frame 65 described later may pass through the guide grooves 611 to be fixed thereto.

The driving motor 62 is fixed to the one inner side of the case 61, and a driving shaft of the driving motor 62 is protruded out of the case 61. A driving gear 621 is coupled to the driving shaft.

The transfer screw 63 is fixed to coupling openings 612 formed on one inner side and the other inner side of the case 61. A shaft gear 631 engaged with the driving gear 621 is provided at one end of the transfer screw 63 so that the rotational motion of the driving gear 621 may be transmitted to the shaft gear 63 to rotate the transfer screw 63. Preferably, if an auxiliary gear 622 disposed between the driving gear 621 and the shaft gear 631 is engaged with the driving gear 621 and the shaft gear 631, the dimensions of the driving gear 621 and the shaft gear 631 can be reduced, so that the driving gear 621 and the shaft gear 631 may not be protruded outwards when the case 61 is secured to the panel unit 20. As a result, it is possible to prevent the driving gear 621 and the shaft gear 631 from being interfered with an external device.

The other end of the transfer screw 63 is inserted into and coupled to the transfer guide 64. If the transfer screw 63 is rotated by the driving motor 62, the transfer guide 64 is transferred in the lengthwise direction along a screw-thread formed on the transfer screw 63.

The transfer screw 63 has a transfer plate 651 fixed to the transfer guide 64, and a pair of fixing plates 652 for connecting the transfer guide 64 and the display unit 30 to each other.

Here, the rotation of the transfer screw 63 allows the transfer plate 651 to be transferred together with the transfer guide 64. Also, a pair of guide rods 66 may be provided on both inner sides of the case 61 so that the transfer plate 651 may be stably transferred along the guide rods 66.

In addition, a pair of fixing plates 652 may be configured to pass through a pair of guide grooves 611 formed on the lower surface of the case 61, respectively. One side of each fixing plat is connected to the transfer plate 651 in the case 61 while the other sides of the fixing plates are connected to both sides of the housing 31, respectively.

And, through holes 652*a* are formed at lower portions of the fixing plates 652, respectively, and a fixing bar 33 traversing the pair of through holes 652*a* is provided at an upper portion of the housing 31. Both ends of the fixing bar 33 are connected to both ends of the upper portion of the housing 31 so that the housing 31 and the display 30 can be naturally rotated according to the movement of the transfer guide 64.

At this time, each through hole 652*a* is formed as a through hole elongated in the vertical direction so that the fixing bar 33 inserted into the through holes 652*a* may be moved upward and downward in the through holes 652*a*.

In other words, if the driving motor 62 is driven in a state where the through holes 652*a* of the fixing plate 652 are connected to the fixing bar 33 of the housing 31, the fixing plate 652 is moved frontward and backward along the transfer guide 64, the housing 31 connected to the fixing plate 652 is rotated with respect to the hinges 32 served as the rotational axis and provided at a lower portion thereof, and the fixing plate 33 is moved upward or downward in the elongated through hole 652*a* along a rotational radius of the housing 31.

As such, if the driving motor 62 is driven by means of the control of the control unit 50 in the angle adjusting device 60, the driving gear 621 connected to the driving motor 62 is rotated, and the shaft gear 631 of the transfer screw 63 configured to be engaged with the driving gear 621 is rotated to rotate the transfer screw 63, so that the transfer guide 64 coupled to the transfer screw 63 is moved frontward and backward. At this time, the transfer frame 65 connected to the transfer guide 64 is also moved together with the transfer guide 64 along the guide rod 66 and the guide groove 611, and the housing 31 connected to the transfer frame 65 is simultaneously rotated with respect to the hinges 32 served as the rotational axis. In other words, the housing 31 surrounding the display unit 30 is secured to the panel unit 20 by means of the hinges 32 provided at the lower portion thereof, and the housing 31 is moved into or out of the panel unit 20 with respect to the hinges 32 served as the rotational axis according to an operation of the angle adjusting device 60 connected to an upper portion of the housing 31, so that the rotational angle is adjusted.

In addition, the rotational range of the display unit 30 is determined by a moving distance of the transfer guide 64 moved along the transfer screw 63. The angle adjusting device 60 further includes a brake 67 for braking the rotation of the transfer screw 63, so that the rotational angle range within which the housing 31 is rotated may be adjusted by means of the control of the control unit 50.

The brake 67 is provided at a location opposite to the driving motor 62 in the case 61 and provided with a first braking gear 671 provided out of the case 61. A second braking gear 632 engaged with the first braking gear 671 is provided at one end of the transfer screw 63 to brake the rotating transfer screw 63.

Next, an operation and usage state of the automated teller machine for a vehicle driver according to the present invention constructed as above are illustrated.

Figure 7:
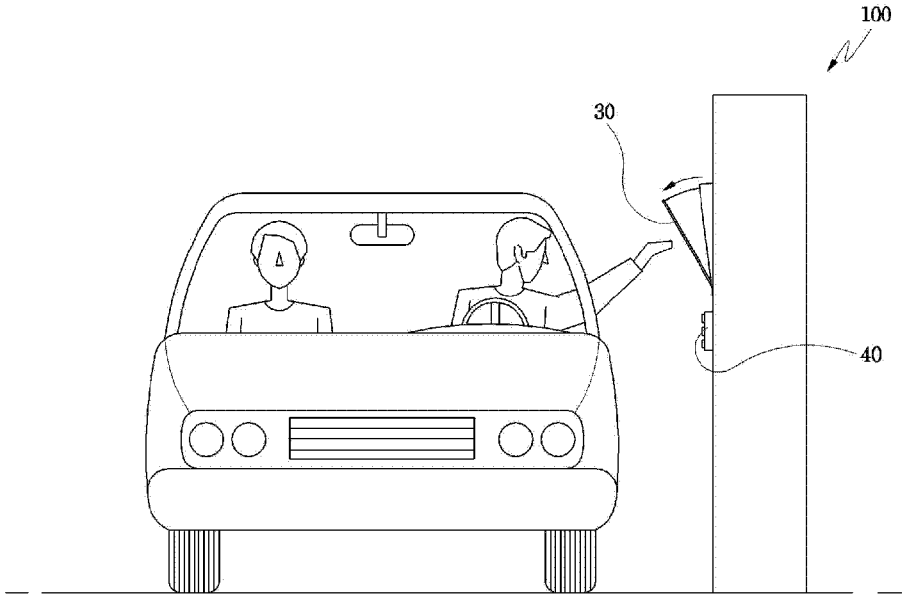
FIG. 7 is a view showing a usage state of an automated teller machine for a vehicle driver according to the first embodiment of the present invention.
Figure 8:
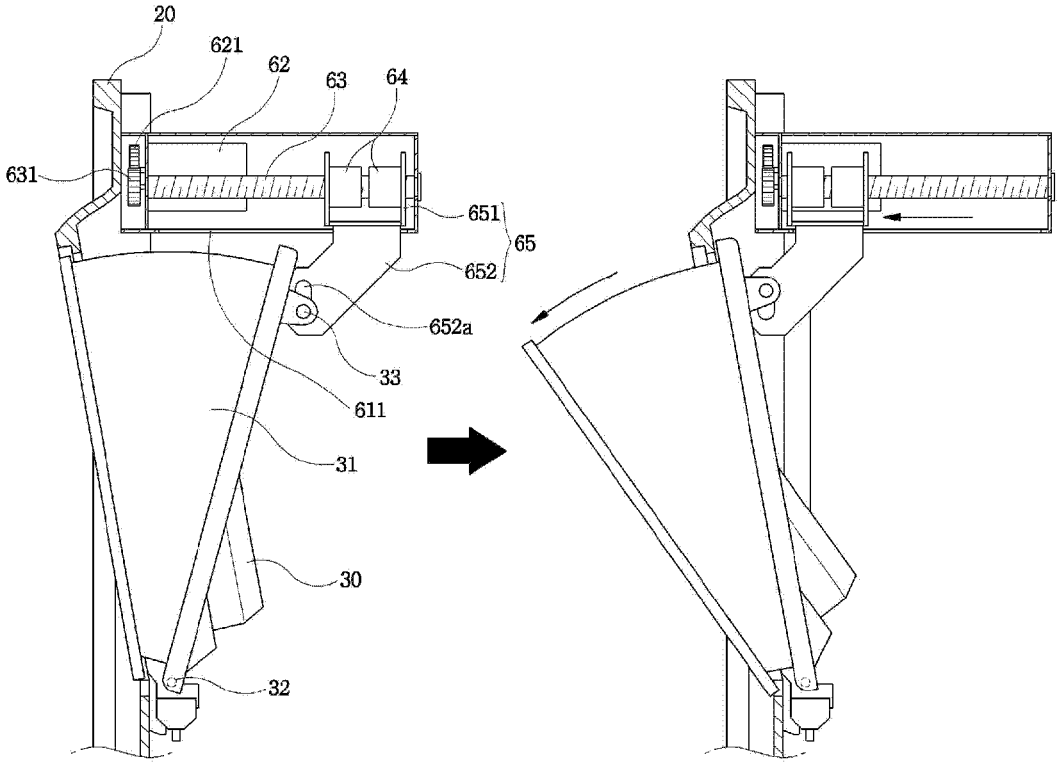
FIG. 8 is a view showing an operating state of an angle adjusting device and a display unit according to the first embodiment of the present invention.

FIG. 7 is a view showing a usage state of an automated teller machine for a vehicle driver according to the first embodiment of the present invention, and FIG. 8 is a view showing an operating state of the angle adjusting device and the display unit according to the first embodiment of the present invention.

Referring to FIG. 7, if a vehicle is introduced in a financial service area and stopped in front of the automated teller machine 100, a driver pushes the operating button of the manual button unit 40 provided on the panel unit of the ATM 100 to adjust the angle of the display unit 30 suitable to a height of the vehicle or the driver's height.

Referring to FIG. 8, if the signal for adjusting the angle of the display unit 30 is inputted from the manual button unit 40, the control unit 50 drives the driving motor 62 of the angle adjusting device 60, the shaft gear 631 of the transfer screw 63, which is engaged with the driving gear 621, is rotated according to the operation of the driving motor 62, and the transfer guide 64 coupled to the transfer screw 63 is moved forward along the screw-thread of the transfer screw 63 by means of the rotation of the transfer screw 63. As a result, the transfer frame 65 fixed to the transfer guide 64 is simultaneously moved in the forward direction.

As such, the pair of fixing plates 652 constituting the transfer frame 65 are also moved forward, and the housing 31 connected to the fixing plates by the fixing bar 33 passing through the through holes 652*a* formed at a lower portion of the fixing plate 652 is rotated forward with respect to the hinge 32 fixed to the lower portion thereof and served as the rotational axis, so that the display unit 30 provided on the housing 31 may be rotated forward.

If the angle of the display unit 30, whose inclination was adjusted as described, is inappropriate, the driver manipulates the operating button of the manual button unit 40 again, so that the display unit 30 may be adjusted to be an angle that is the most comfortable for the driver. Even in this case, it will be apparent that the angle adjusting device 30 is operated through the manner which is the same as that described with reference to FIG. 8.

If an angle adjustment of the display unit 30 is completed, the driver touches a surface of the display unit 30 to input the data and to conduct a predetermined financial transaction.

Thereinafter, if a predetermined transaction is completed, the display unit is returned to its original state.

Hereinafter, other embodiments of the automated teller machine for a vehicle driver according to the present invention constituted as described above will be illustrated.

Figure 9:
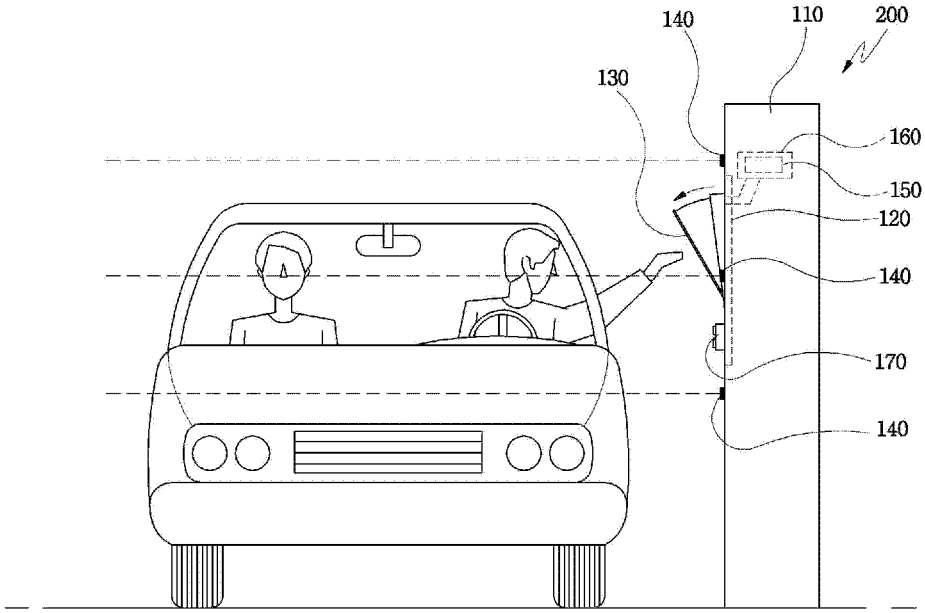
FIG. 9 is a view showing a configuration and usage state of an automated teller machine for a vehicle driver according to the second embodiment of the present invention.

FIG. 9 is a view showing a configuration and usage state of an automated teller machine for a vehicle driver according to the second embodiment of the present invention.

Referring to FIG. 9, an automated teller machine 200 for a vehicle driver according to the second embodiment of the present invention comprises a main body 110 installed in a financial service area, a panel unit 120 provided on a front surface of the main body 110 to be provided with a financial transaction means, a display unit 130 provided at one side of the panel unit 120 to be rotatable frontward and rearward, a sensing unit 140 provided at the main body 110 to recognize the height of a vehicle, and a control unit 50 for controlling a rotational angle of the display unit 130 through a signal transmitted from the sensing unit 140.

Here, a configuration and operation of each of the main body 110, the panel unit 120, the display unit 130 and the control unit 150 of the automated teller machine 200 for a vehicle driver according to the second embodiment of the present invention are the same as those of each of the structural members constituting of the automated teller machine according to the first embodiment shown in FIG. 3 and FIG. 4.

In the sensing unit 140, a plurality of sensors are vertically disposed on one side of a front surface of the main body 110 to sense the height of vehicle introduced in the financial service area. Here, the ultrasonic sensor, the infrared sensor and the like may are utilized as the sensor.

If the sensing unit 140 measures the height of the vehicle, for example, heights of the roof and the window of the vehicle, and transmits the signal to the control unit 150, the control unit 150 controls the angle adjusting device to enable the display unit 130 to be rotated by an angle corresponding to a measured height of the vehicle.

A manual button unit 170 may be further provided on the main body 110. In this case, in a state where the play unit 130 is inclined at a certain angle by the sensing unit 140, the driver manipulates the manual button unit 170 to finely adjust the angle of the display unit 140, so that the display unit 130 may be adjusted to a state that is suitable for a position of the driver.

Figure 10:
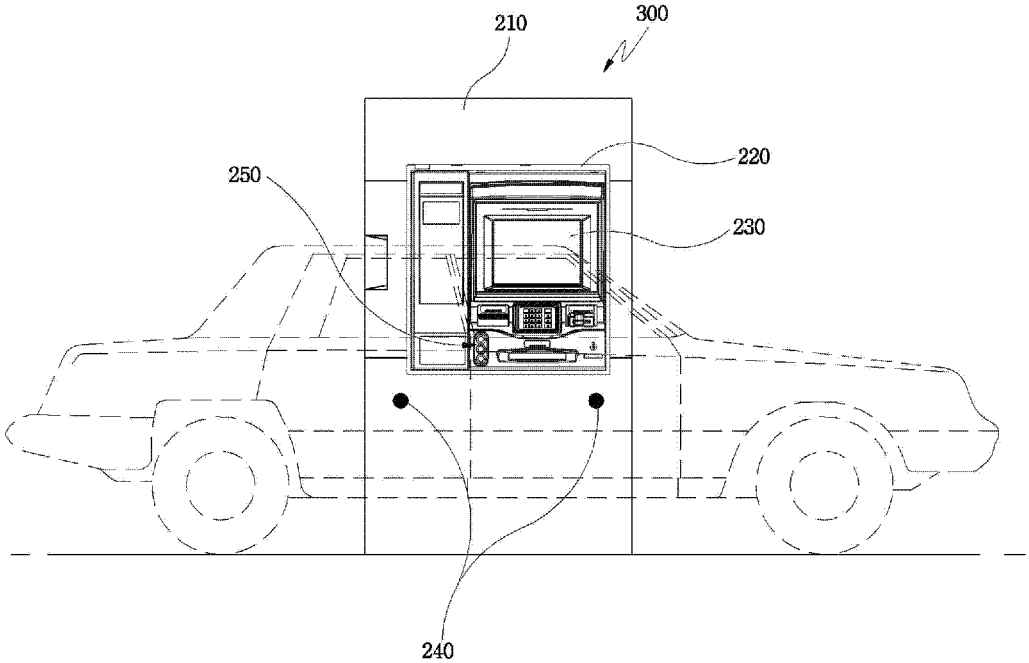
FIG. 10 is a view showing a configuration and usage state of an automated teller machine for a vehicle driver according to the third embodiment of the present invention.

FIG. 10 is a view showing a configuration and usage state of an automated teller machine for a vehicle driver according to the third embodiment of the present invention.

Referring to FIG. 10, an automated teller machine 300 for a vehicle driver according to the third embodiment of the present invention comprises a main body 210 installed in a financial service area, a panel unit 220 provided on a front surface of the main body 210 to be provided with a financial transaction means, a display unit 230 provided at one side of the panel unit 220 to be rotatable frontward and rearward, a sensing unit 240 provided at a front surface of the main body 210 to recognize whether a vehicle is introduced in front of the main body; and a control unit (not shown) for controlling a rotational angle of the display unit 230 through a signal transmitted from the sensing unit 240.

Here, a configuration and operation of each of the main body 210, the panel unit 220, the display unit 230 and the control unit (not shown) of the automated teller machine 300 for a vehicle driver according to the third embodiment of the present invention are the same as those of each of the structural members constituting of the automated teller machine according to the first embodiment shown in FIG. 3 and FIG. 4.

In the sensing unit 240, a plurality of sensors are horizontally disposed on one side of a front surface of the main body 11 to determine whether a vehicle is introduced in front of the main body 210. Here, the ultrasonic sensor, the infrared sensor and the like may are utilized as the sensor.

The sensing unit 240 transmits a signal to the control unit (not shown) only in a case where a plurality of sensors may sense simultaneously an object, that is, a vehicle. In other words, if a vehicle is stopped in front of the automated teller machine 300 for a vehicle driver according to the third embodiment of the present invention, a plurality of sensors disposed on the main body 210 sense simultaneously the object due to a length of vehicle and transmit the signal to the control unit (not shown), and the control unit (not shown) drives the angle adjusting device (not shown) in response to the signal so that an angle of the display unit 230 is automatically adjusted. At this time, the display unit 230 can be inclined at a maximum rotational angle or at an approximately intermediary angle within a rotational angle range. The rotational angle of the display unit can be determined by a predetermined angle in the control unit (not shown).

A manual button unit 250 may be further provided in the main body 210. In this case, in the state where the display unit 230 is inclined at a certain angle by the sensing unit 240, the driver manipulates the manual button unit 250 to finely adjust the angle of the display unit 230, so that the display unit may be adjusted to a state that is suitable for the position of the driver.

As described above, the automated teller machine for a vehicle driver is advantageous in that since an angle of the display unit is adjusted by sensing a vehicle through the sensing unit and the driver within a vehicle can adjust directly and finely a height of the display unit so that the vehicle driver can verify the information and input information conveniently to perform easily the financial transaction. In addition, a vertical distance and a horizontal distance between the vehicle driver and the display unit are adjusted by only the angle adjustment for the display unit without moving the main body, so that the present invention has the advantageous effects in that the automated teller machine may be installed in a narrow space and the efficiency of the machine may be increased due to the low power consumption.

It will be understood by those skilled in the art that various modifications and substitutions can be made thereto without departing from the spirit and scope of the invention defined by the appended claims. Therefore, the present invention is not limited to the aforementioned embodiment and the accompanying drawings.

What is claimed is:

1. An automated teller machine for vehicle drivers, comprising:

a main body installed in a financial service area;

a panel unit provided on a front surface of the main body;

a display unit provided at one side of the panel unit;

a housing secured to the display unit, the housing comprising:

two wedge shaped side edges having hinges at a lower portion and arc shaped upper portions, the display housing rotatable frontward and rearward by rotation of the hinges; and two protruding portions extending from the arc shaped upper portions for securing opposite ends of a fixing bar;

a manual button unit provided at a predetermined location in the panel unit for a vehicle driver to control a rotational angle of the display unit;

a control unit for controlling the rotational angle of the display unit through a signal transmitted from the manual button unit; and an angle adjusting device for rotating the display unit and the housing, comprising:

a case having a pair of guide grooves formed on both sides of a lower surface thereof;

a driving motor provided at one side of the case;

a driving gear provided out of the case to be connected to the driving motor;

a shaft gear provided at one side of the driving gear to be engaged with the driving gear;

a transfer screw fixed within the case, the transfer screw having one end connected to the shaft gear to receive a rotational motion of the driving gear;

a transfer guide inserted into and coupled to the other end of the transfer screw so that the rotation of the transfer screw allows the transfer guide to be transferred in the lengthwise direction of the transfer screw;

a transfer frame having a transfer plate fixed to the transfer guide and a pair of fixing plates each having one side connected to the transfer plate and the other side extending through the corresponding guide groove, a vertically elongated hole formed on each of the fixing plates for receiving the fixing bar, the fixing bar sliding vertically with rotation of the display housing; and a brake for braking the rotation of the transfer screw to limit the range of the rotational angle of the display unit, wherein the brake comprises a first braking gear provided out of the case and a second braking gear, which is engaged with the first braking gear, provided at one end of the transfer screw.

2. An automated teller machine for vehicle drivers, comprising:

a main body installed in a financial service area;

a panel unit provided on a front surface of the main body;

a display unit provided at one side of the panel unit;

a housing secured to the display unit, the housing comprising:

two wedge shaped side edges having hinges at a lower portion and arc shaped upper portions, the display housing rotatable frontward and rearward by rotation of the hinges; and two protruding portions extending from the arc shaped upper portions for securing opposite ends of a fixing bar;

a sensing unit provided on the front surface of the main body to recognize the height of a vehicle introduced in front of the main body;

a manual button unit for a vehicle driver to additionally adjust a rotational angle of the display unit;

a control unit for controlling a rotational angle of the display unit and the housing through a signal transmitted from the sensing unit and the manual button unit; and an angle adjusting device for rotating the display unit, comprising:

a case having a pair of guide grooves formed on both sides of a lower surface thereof;

a driving motor provided at one side of the case;

a driving gear provided out of the case to be connected to the driving motor;

a shaft gear provided at one side of the driving gear to be engaged with the driving gear;

a transfer screw fixed within the case, the transfer screw having one end connected to the shaft gear to receive a rotational motion of the driving gear;

a transfer guide inserted into and coupled to the other end of the transfer screw so that the rotation of the transfer screw allows the transfer guide to be transferred in the lengthwise direction of the transfer screw;

a transfer frame having a transfer plate fixed to the transfer guide and a pair of fixing plates each having one side connected to the transfer plate and the other side extending through the corresponding guide groove, a vertically elongated hole formed on each of the fixing plates for receiving the fixing bar, the fixing bar sliding vertically with rotation of the display housing; and a brake for braking the rotation of the transfer screw to limit the range of the rotational angle of the display unit, wherein the brake comprises a first braking gear provided out of the case and a second braking gear, which is engaged with the first braking gear, provided at one end of the transfer screw.

3. The automated teller machine as claimed in claim 2, wherein the sensor unit includes a plurality of sensors vertically disposed on the front surface of the main body to determine the height of the vehicle.

4. The automated teller machine as claimed in claim 3, wherein each sensor comprises an infrared sensor or an ultrasonic sensor.

* * * * *